US006760035B2

(12) United States Patent
Tjandrasuwita

(10) Patent No.: US 6,760,035 B2
(45) Date of Patent: Jul. 6, 2004

(54) BACK-END IMAGE TRANSFORMATION

(75) Inventor: Ignatius B. Tjandrasuwita, Union City, CA (US)

(73) Assignee: NViDiA Corporation, Santa Clara, CA (US)

( * ) Notice: Subject to any disclaimer, the term of this patent is extended or adjusted under 35 U.S.C. 154(b) by 299 days.

(21) Appl. No.: 10/045,402

(22) Filed: Nov. 19, 2001

(65) Prior Publication Data

US 2003/0095124 A1 May 22, 2003

(51) Int. Cl.[7] ..... G09G 5/36

(52) U.S. Cl. ..... 345/545; 345/656; 345/564; 345/571; 382/296

(58) Field of Search ..... 345/538, 536, 345/537, 545, 501, 502, 427, 645, 649, 656, 658, 659, 564, 566, 568, 571, 572, 672, 682; 382/293, 295, 296, 297

(56) References Cited

U.S. PATENT DOCUMENTS 4,554,638 A * 11/1985 Iida ..... 345/658
4,742,474 A * 5/1988 Knierim ..... 345/545
6,226,016 B1 * 5/2001 Chee et al. ..... 345/658
6,452,601 B1 * 9/2002 Marino et al. ..... 345/538
6,639,603 B1 * 10/2003 Ishii ..... 345/658

* cited by examiner

*Primary Examiner*—Kee M. Tung
(74) *Attorney, Agent, or Firm*—Nguyen & Associates

(57) ABSTRACT

A method to perform image transformations that are simplistic, conducive to miniaturization, and inexpensive to implement is provided. Transformations of an image stored in system memory are carried out by copying the image data, transforming the image data to a selected orientation, and outputting the transformed image for display, printing, or others. Throughout the transformation process, the image stored in system memory remains unchanged in the original orientation (T0-normal transformation). The transformation process is carried out by accessing in predetermined orders/sequences the image data copied from system memory to a frame buffer that is made up of N memory modules and arranged such that image data are stored serially with the image scan lines running the length of the frame buffer like that of a traditional frame buffer but with each memory module capable of being individually accessed. A line stride value S has been specifically derived to control the location of corresponding pixels of N adjacent rows of the image data so that these pixels appear in N different memory modules. In so doing, the start of each scan line (and consequently image data associated with the scan line) can be individually accessed by accessing a memory module. Such access makes it easier to manipulate the image data to perform different types of image transformations.

20 Claims, 14 Drawing Sheets

T0-TRANSFORM
NORMAL

T1-TRANSFORM
HORIZONTAL-FLIP

T2-TRANSFORM
VERTICAL-FLIP

T3-TRANSFORM
180-DEGREE ROTATION

T4-TRANSFORM
SWAP XY

T5-TRANSFORM
270-DEGREE ROTATION

T6-TRANSFORM
90-DEGREE ROTATION

T6-TRANSFORM
SWAP XY W/ HOR. &
VERTICAL FLIPS

T0-TRANSFORM

T1-TRANSFORM

T2-TRANSFORM

T3-TRANSFORM

T4-TRANSFORM

T5-TRANSFORM

T6-TRANSFORM

T7-TRANSFORM

| M0 | | M1 | | M2 | | M3 | |
|---|---|---|---|---|---|---|---|
| BYTE 0 | BYTE 1 | BYTE 2 | BYTE 3 | BYTE 4 | BYTE 5 | BYTE 6 | BYTE 7 |
| A=0 | A=1 | A=2 | A=3 | A=4 | A=5 | A=6 | A=7 |
| A=8 | A=9 | A=10 | A=11 | A=12 | A=13 | A=14 | A=15 |
| | | | | | | | |
| | | P(0,0) A=SA | | P(1,0) A=SA+2 | | P(2,0) A=SA+4 | |
| P(3,0) A=SA+6 | | ⋮ | | ⋮ | | ⋮ | |
| ⋮ | | P(W-4,0) A=SA+2(W-4) | | P(W-3,0) A=SA+2(W-3) | | P(W-2,0) A=SA+2(W-2) | |
| P(W-1,0) A=SA+2(W-1) | | | | P(0,1) A=SA+S | | P(1,1) A=SA+S+2 | |
| P(2,1) A=SA+S+4 | | P(3,1) A=SA+S+6 | | ⋮ | | ⋮ | |
| ⋮ | | ⋮ | | P(W-4,1) A=SA+S+2(W-4) | | P(W-3,1) A=SA+S+2(W-3) | |
| P(W-2,1) A=SA+S+2(W-2) | | P(W-1,1) A=SA+S+2(W-1) | | | | P(0,2) A=SA+2S | |
| P(1,2) A=SA+2S+2 | | P(2,2) A=SA+2S+4 | | P(3,2) A=SA+2S+6 | | ⋮ | |
| ⋮ | | ⋮ | | ⋮ | | P(W-4,2) A=SA+2S+2(W-4) | |
| P(W-3,2) A=SA+2S+2(W-3) | | P(W-2,2) A=SA+2S+2(W-2) | | P(W-1,2) A=SA+2S+2(W-1) | | | |
| P(0,3) A=SA+3S | | P(1,3) A=SA+3S+2 | | P(2,3) A=SA+3S+4 | | P(3,3) A=SA+3S+6 | |
| ⋮ | | ⋮ | | ⋮ | | ⋮ | |
| P(W-4,3) A=SA+3S+2(W-4) | | P(W-3,3) A=SA+3S+2(W-3) | | P(W-2,3) A=SA+3S+2(W-2) | | P(W-1,3) A=SA+3S+2(W-1) | |
| | | | | | | | |

FIG. 5B

HORIZONTALACTIVEAREA FIG. 7A
HORIZONTALSYNC FIG. 7B
HORIZONTALBLANK FIG. 7C
LINECLOCK FIG. 7D
DISPLAY
ACTIVE AREA
BLANK AREA
VERTICALBLANK FIG. 7H
VERTICALSYNC FIG. 7G
FIRSTLINE FIG. 7E
VERTICALACTIVEAREA FIG. 7F

BACK-END IMAGE TRANSFORMATION

FIELD OF THE INVENTION

The invention generally relates to computer systems, and more particularly relates to display image rotation (transformation).

BACKGROUND OF THE INVENTION

With the advances of semiconductor and computer technology, computer systems are becoming faster and at the same time smaller in size. The tasks performed by computer systems are also becoming increasingly more complex. This is particularly true in the area of computer graphics. Computer systems are now capable of generating complex and high-resolution 3 dimensional (3D) graphics objects with lifelike movements. These 3D graphics objects require a great deal of data transfer (e.g., retrieving the attributes data related to the object such as data block height, width, color, and texture from system memory) and processing (e.g., computing the color and texture values for the object's pixels to accurately reflect the object's shading at a position). For these reasons, improved performance (e.g., speed) is a never-ending quest in the area of computer graphics.

Generally, to render a graphics image in a computer system, computer graphics objects are first constructed with combinations of graphics primitives using a graphics application program. The graphics primitives are connected together to form a geometrical model of the desired graphics object or picture to be displayed on the monitor. The graphics model is a linked data structure that contains a detailed geometric description of the graphics object and its associated attributes (e.g., color, shading, texture, lighting, etc.) describing how the object should appear. Data related to the graphics model are stored in the computer system memory. On the other hand, data ready to be displayed on the monitor is stored as a pixmap in a frame buffer (i.e., a pixel pattern mapped into the frame buffer). In response to a user graphics command (e.g., a Raster Operation (ROP)), graphics data from the system memory and from the frame buffer are retrieved with the help of the Central Processor (CPU) and the Memory Interface Unit (MIU) and provided to the Graphics Engine (GE) for processing. The processed data is then provided with the help of the MIU to the frame buffer for subsequent display by the monitor. In displaying a graphics image, it may be desirable at times to transform the image from one orientation to another orientation. An image transformation generally involves accessing and manipulating the stored image data.

There are seven different display image transformations T1–T7 relative to a display image originally created. The display image as originally created is referred to as the normal (T0) transformation. Reference is now made to FIGS. 1A–1H illustrate these eight different display image transformations. FIG. 1A illustrates a display image as it is originally created without any transformation which is commonly referred to a normal transformation T0. FIG. 1B illustrates a horizontal-flip transformation T1 of the original display image. As its name suggests, a horizontal-flip transformation involves flipping the original display image about a vertical axis. FIG. 1C illustrates a vertical-flip transformation T2 of the original display image. As its name suggests, a vertical-flip transformation involves flipping the original display image about a horizontal axis. FIG. 1D illustrates a horizontal-vertical-flip transformation T3 of the original display image. As its name suggests, a horizontal-vertical-flip transformation involves flipping the original display image about a vertical axis and a horizontal axis (in any particular order) which is the equivalent of rotating the original image 180-degree counter-clockwise. FIG. 1E illustrates a swap XY transformation T4 of the original display image. In a swap XY transformation, pixel data of the original display image (normal transformation) along the X-coordinates are exchanged with pixel data along the Y-coordinates. In other words, the swap XY transformation involves flipping the original display image about a 45-degree axis. FIG. 1F illustrates a swap-xy-horizontal-flip transformation T5 of the original display image. As its name suggests, a swap-xy-horizontal-flip transformation involves swapping pixel data along the X-coordinates with pixel data along the Y-coordinates and flipping the swapped pixel data about a vertical axis. This transformation is equivalent to rotating the original image 270-degree counter-clockwise. FIG. 1G illustrates a swap-xy-vertical-flip transformation T6 of the original display image. As its name suggests, a swap-xy-vertical-flip transformation involves swapping pixel data along the X-coordinates with pixel data along the Y-coordinates and flipping the swapped pixel data about a horizontal axis. This transformation is equivalent to rotating the original image 90-degree counter-clockwise. Finally, FIG. 1H illustrates a swap-xy-horizontal-flip-and-vertical-flip transformation T6 of the original display image. As its name suggests, a swap-xy-horizontal-flip-and-vertical-flip transformation involves swapping pixel data along the X-coordinates with pixel data along the Y-coordinates and flipping the swapped pixel data about both a vertical axis and a horizontal axis.

To speed up the transformation process, display image transformations are preferably hardware based. Traditionally, display image transformations are performed in the front-end when the display image data is retrieved from system memory prior to being sent to the frame buffer. In this traditional approach, the transformations are carried out by the source circuitry (e.g., the CPU, the graphics engine, the video controller, etc.) that writes the image into the frame buffer. Because there may be more than one source, following this approach, each of these sources needs the capability to do display image transformations which may add an undesirable level of redundancy and complexity.

U.S. Pat. No. 4,554,638 titled "Display Device Including Apparatus for Rotating the Image to be Displayed" issued to Kazuhiko Iida (hereinafter the '638 patent) teaches an implementation of the aforementioned traditional approach. Under the '638 patent, the image data revolution circuit inside the display interface unit transforms display image data received from memory (page buffer) before sending the transformed image data to refresh memories (i.e., frame buffer) for output to the Cathode-Ray-Tube (CRT) display. The image data revolution circuit has a plurality of Random-Access-Memory (RAM) chips arranged in a matrix fashion corresponding to the X and Y coordinates of the display image such that individual memory cells in the RAM chips can be randomly accessed using row and column addresses. By storing the display image received in the RAM chips, information contained in any memory row or column can be accessed which allows display image transformations to be carried out. FIGS. 2A–2H illustrate the memory locations access sequences that correspond to the T0–T7 display image transformations discussed earlier. In other words, by accessing and outputting the stored display image data in a predetermined sequence (as illustrated in FIGS. 2A–2H), any one of the aforementioned transformations can be achieved. However, to allow individual memory cells in the memory matrix to be accessed individually and randomly, the '638 patent requires the RAM chips to be fully connected in both X and Y directions as well as extra hardware to carry out the tasks associated with sequencing, address decoding, memory selecting, etc. This translates to added costs as well as increased size which is undesirable in today's era of miniaturization.

On the other hand, U.S. Pat. No. 4,703,515 titled "Image Rotation" issued to Anthony Baroody, Jr. (hereinafter the '515 patent) teaches a variation of the aforementioned traditional approach. Under the '515 patent, the video controller initiates the transformation process when image data is read from system memory and before the image data is stored in the frame buffer. The frame buffer is designed so as to physically accommodate both a standard configuration and a folded configuration. In the standard configuration, image data is mapped into the frame buffer such that the scan lines of the image data run the length of the frame buffer to accommodate portrait mode printing. Conversely, in the folded configuration, image data is mapped into the frame buffer such that the scan lines of the image data run across the frame buffer (i.e., 90-degree to the length of the frame buffer) to accommodate landscape mode printing. Hence, data storage is physically different in the two aforementioned configurations. Additional image transformations, more specifically inverse portrait in which the original portrait image is rotated 180 degrees and inverse landscape in which the original landscape image is rotated 180 degrees, can be carried out by the output controller by accessing the stored image data in the frame buffer for output in a reverse direction from the way the image data is stored. Accordingly, in addition to requiring different stages for some image transformations which are somewhat cumbersome and complex, the implementation under the '515 patent further requires a frame buffer that is physically configured to accommodate both a standard configuration and a folded configuration which may add undesired costs.

Thus, a need exists for an apparatus, system, and method for transforming display image that are conducive to miniaturization and inexpensive to implement.

SUMMARY OF THE INVENTION

Accordingly, the present invention provides an apparatus, system, and method for transforming display image that are conducive to miniaturization and inexpensive to implement.

The present invention meets the above need with a graphics controller which is coupled to system memory. The graphics controller comprises a frame buffer and combinational logic which is coupled to the frame buffer. The frame buffer consists of N memory modules for storing image data copied from the system memory, wherein each memory module is individually accessible. The image data stored in the frame buffer is arranged serially based on a line stride value such that corresponding pixels of N adjacent rows of the stored image data locate in N different memory modules. The combinational logic generates a starting address signal and control signals used in selectively accessing the stored imaged data in the frame buffer for output in a sequence such that the output image data is transformed.

All the features and advantages of the present invention will become apparent from the following detailed description of its preferred embodiment whose description should be taken in conjunction with the accompanying drawings.

BRIEF DESCRIPTION OF THE DRAWINGS

FIG. 5B illustrates, as an example, a physical representation of the display image relative to frame buffer 402 for 16 Bits-Per-Pixel (bpp) color mode.

DETAILED DESCRIPTION OF THE INVENTION

Figure 1A:
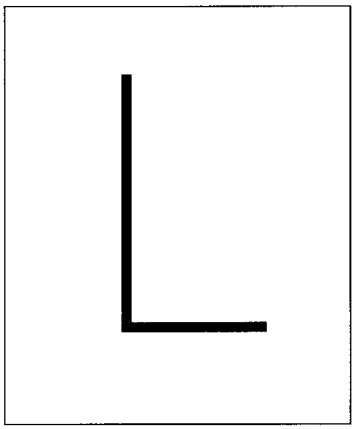
FIGS. 1A–1H illustrate the eight widely known display image transformations T0–T7.
Figure 1B:
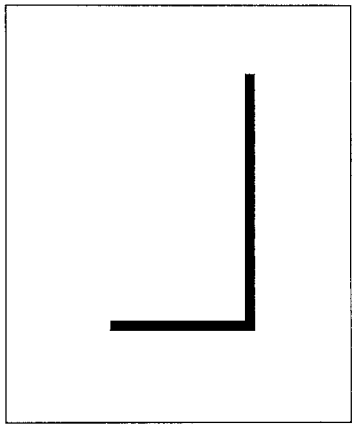
Figure 1C:
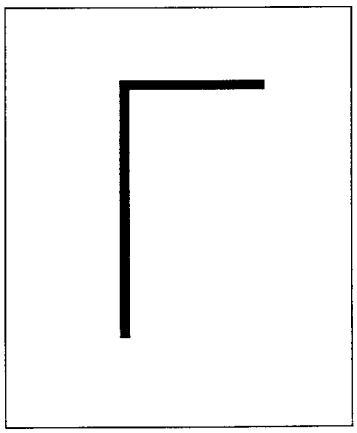
Figure 1D:
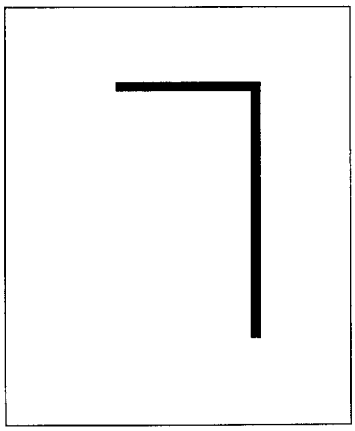
Figure 1E:
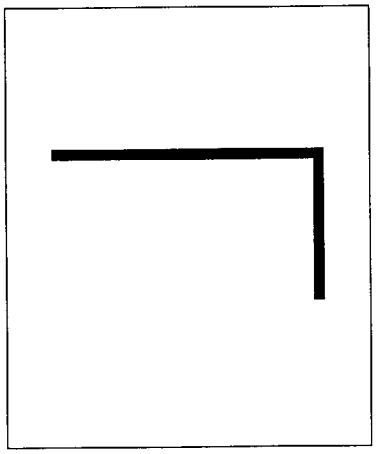
Figure 1F:
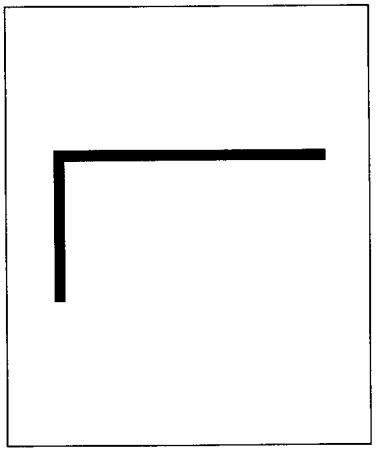
Figure 1G:
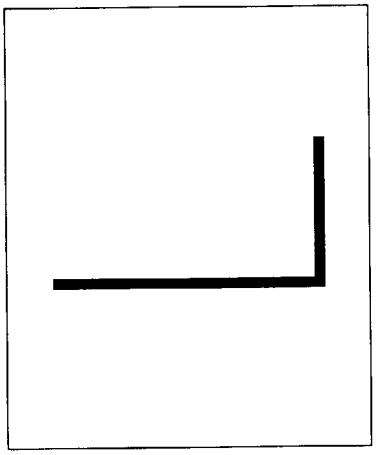
Figure 1H:
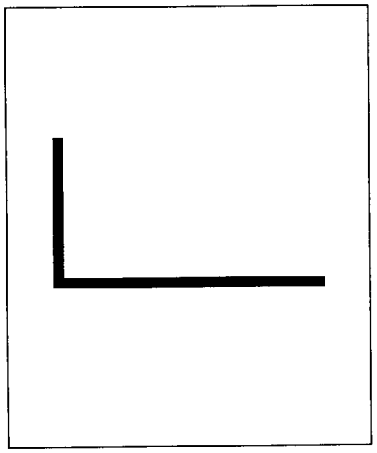
Figure 2A:
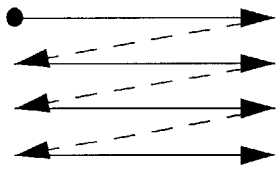
FIGS. 2A–2H illustrate the memory locations access sequences that correspond to the T0–T7 display image transformations.
Figure 2B:
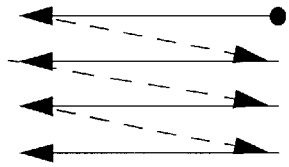
Figure 2C:
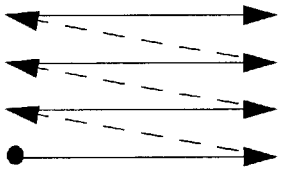
Figure 2D:
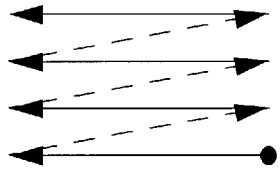
Figure 2E:
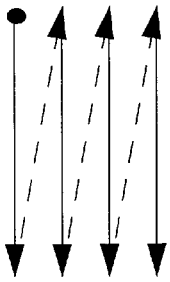
Figure 2F:
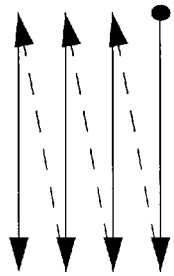
Figure 2G:
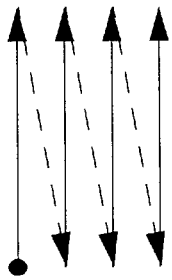
Figure 2H:
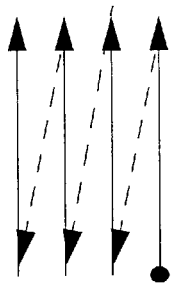

In the following detailed description of the present invention, numerous specific details are set forth in order to provide a thorough understanding of the present invention. However, it will be obvious to one skilled in the art that the present invention may be practiced without these specific details. In other instances well known methods, procedures, components, and circuits have not been described in detail as not to unnecessarily obscure aspects of the present invention. While the following detailed description of the present invention describes its application in an embodiment involving a computer system with a display device, it is to be appreciated that the present invention is also applicable to other embodiments involving a printer, a scanner, copier, or others.

In accordance with the present invention, transformations of an image stored in system memory are carried out by copying the image data into a frame buffer, transforming the image data to a selected orientation, and outputting the transformed image for display, printing, or others. Throughout the transformation process, the image stored in the frame buffer remains unchanged in the original orientation (T0-normal transformation) The transformation process is carried out by accessing in predetermined orders/sequences the image data copied from system memory to a frame buffer that is made up of N memory modules and arranged such that image data are stored serially with the image scan lines running the length of the frame buffer (i.e., linearly addressed within a line) like that of a traditional frame buffer but with each memory module capable of being individually accessed. A line stride value S has been specifically derived and used to control NxQ horizontal adjacent pixels to be located in N different memory modules and to control the location of corresponding pixels of N adjacent rows of the image data so that these pixels appear in N different memory modules. In other words, the line stride is derived so that any NxQ consecutive horizontal adjacent pixels in a display image row are located in N different memory modules and corresponding pixels of N adjacent rows in an image must appear in N different memory modules when the image data is copied into the frame buffer. Hence, the number of memory modules N determines the number of maximum consecutive vertically adjacent pixels that can be read in one memory read cycle. In so doing, the start of each scan line (and consequently image data associated with the scan line) can be individually accessed by accessing a memory module without requiring individual memory cells in each memory module to be connected in both the X and Y directions. Such access makes it easier to manipulate the image data to perform different types of image transformations (e.g., T4–T7). In one embodiment, a line stride value S that meets the above objective is defined as:

$$S=(N\times I)+(P\times Q) \quad (1)$$

where N is the number of individually accessible memory modules that make up the frame buffer, I is an integer which is typically selected such that S is equal to or larger than the line length, P is either 1 or any odd prime number, and Q is the number of pixels stored in each memory cell location which spans the width of a memory module. In the present embodiment, P is set to 1. Other equations that satisfies the requirement that corresponding pixels of N adjacent rows of locate in N different memory modules are also within the scope of the present invention.

Figure 3:
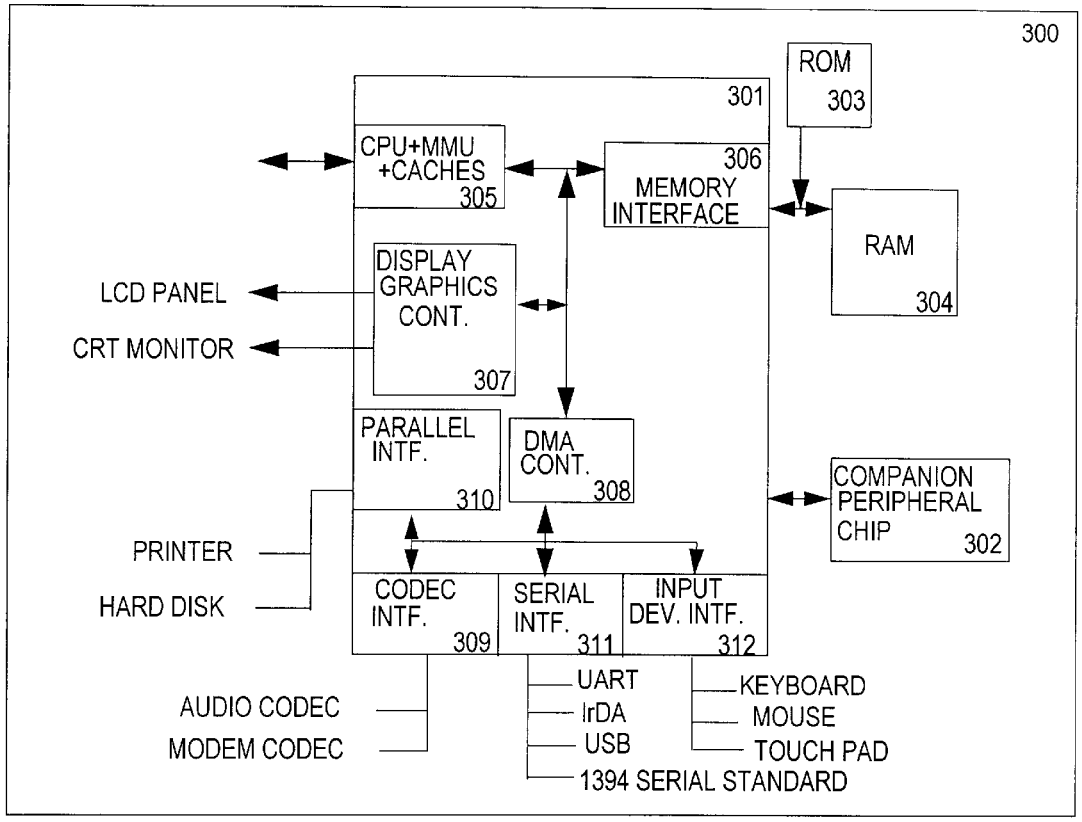
FIG. 3 illustrates, as an example, a high-level diagram of computer system 300 in which the present invention may be implemented or practiced.

Reference is now made to FIG. 3 illustrates, as an example, a high-level diagram of computer system 300 in which the present invention may be implemented or practiced. More particularly, computer system 300 may be a laptop or hand-held computer system. It is to be appreciated that computer system 300 is exemplary only and that the present invention can operate within a number of different computer systems including desktop computer systems, general-purpose computer systems, embedded computer systems, and others.

As shown in FIG. 3, computer system 300 is a highly integrated system which includes of integrated processor circuit 301, peripheral controller 302, read-only-memory (ROM) 303, and random access memory (RAM) 304. The highly integrated architecture allows power to be conserved. Computer system architecture 300 may also include a peripheral controller if there is a need to interface with complex and/or high pin-count peripherals that are not provided in integrated processor circuit 301.

While peripheral controller 302 is connected to integrated processor circuit 301 on one end, ROM 303 and RAM 304 are connected to integrated processor circuit 301 on the other end. Integrated processor circuit 301 comprises a processing unit 305, memory interface 306, graphics/display controller 307, direct memory access (DMA) controller 308, and core logic functions including encoder/decoder (CODEC) interface 309, parallel interface 310, serial interface 311, input device interface 312, and flat panel interface (FPI) 313. Processing unit 305 integrates a central processing unit (CPU), a memory management unit (MMU), together with instruction/data caches.

CODEC interface 309 provides the interface for an audio source and/or modem to connect to integrated processor circuit 301. Parallel interface 310 allows parallel input/output (I/O) devices such as hard disks, printers, etc. to connect to integrated processor circuit 301. Serial interface 311 provides the interface for serial I/O devices such as universal asynchronous receiver transmitter (UART) to connect to integrated processor circuit 301. Input device interface 312 provides the interface for input devices such as keyboard, mouse, and touch pad to connect to integrated processor circuit 301.

DMA controller 308 accesses data stored in RAM 304 via memory interface 306 and provides the data to peripheral devices connected to CODEC interface 309, parallel interface 310, serial interface 311, or input device interface 312. Graphics/display controller 307 requests and accesses the video/graphics data from RAM 304 via memory interface 306. Graphics/display controller 307 then processes the data, formats the processed data, and sends the formatted data to a display device such as a liquid crystal display (LCD), a cathode ray tube (CRT), or a television (TV) monitor. In computer system 100, a single memory bus is used to connect integrated processor circuit 301 to ROM 303 and RAM 304.

Figure 4:
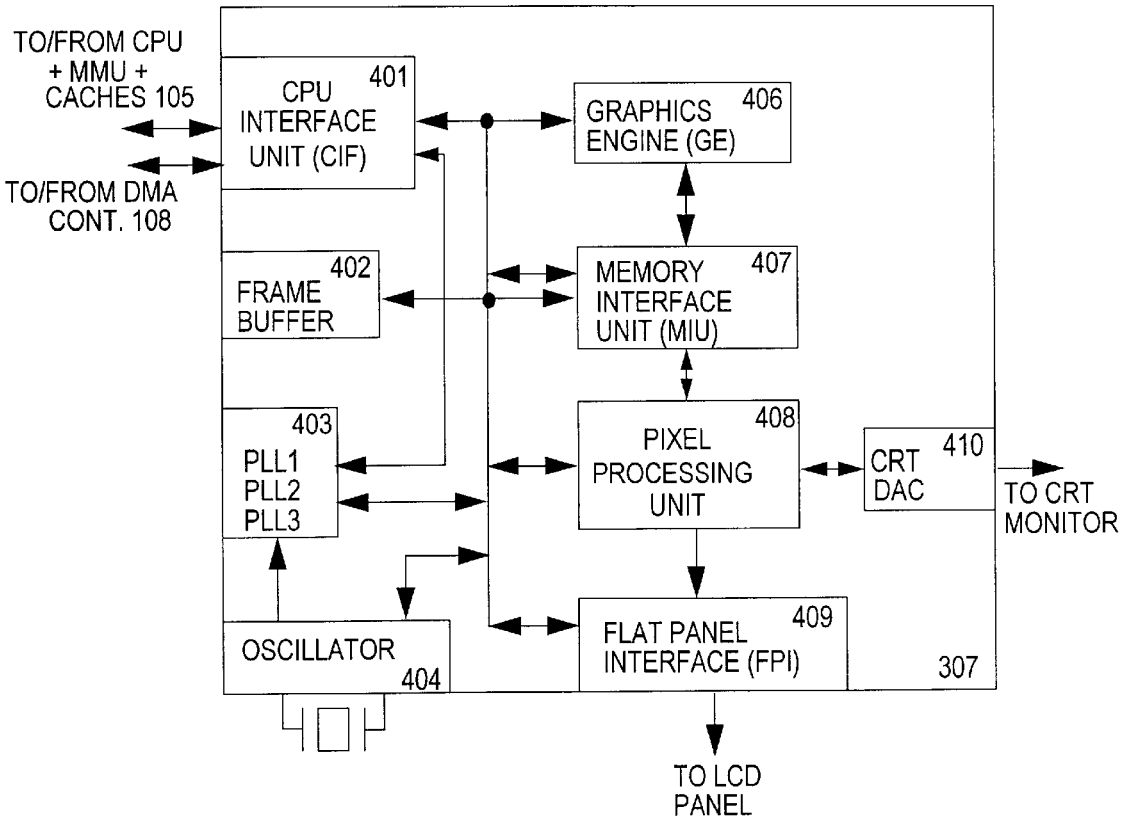
FIG. 4 illustrates in greater detail graphics/display controller 307.

In the preferred embodiment, the present invention is implemented as part of graphics/display controller 307. Reference is now made to FIG. 4 illustrating in greater detail graphics/display controller 307. In general, graphics/display controller 307 comprises CPU Interface Unit (CIF) 401, frame buffer 402, Phase Lock Loop (PLL) circuit 403, oscillator 404, pixel processing logic 408, Graphics Engine (GE) 406, Memory Interface Unit (MIU) 407, Flat Panel Interface (FPI) 409, and CRT Digital-to-Analog Converter (DAC) 410. CIF 401 provides the interface to processing unit 305 and DMA controller 308. Accordingly, CIF 401 routes requests and image data received from processing unit 305 to the desired destination. In particular, CIF 401 sends register read/write requests and memory read/write requests from the host CPU processing unit 305 and DMA controller 308 to the appropriate modules in graphics/display controller 307. For example, memory read/write requests are passed on to MIU 407 which in turn reads/writes the data from/to frame buffer 402. CIF 401 also serves as the liaison with DMA controller 308 to fetch data from system memory (ROM 303 and RAM 304) and provides the data to GE 406 and MIU 407. Further, CIF 401 has a number of registers that are programmable by the host CPU in processing unit 305 to control the image transformation process of graphics/display controller 307. Examples of some of these programmable registers include those that provide the SwapXY signal, Hdir signal, and Vdir signal.

Frame buffer 402 is used to store the pixmap (i.e., a pixel pattern mapped into the frame buffer) of the image to be displayed on the monitor as well to act as a temporary buffer for various purposes. In accordance with the present invention, image transformations are carried out by accessing and manipulating the pixmap stored in frame buffer 402 in predetermined orders/sequences. Oscillator 404 provides a reference clock signal to PLL circuit 403 which in turn generates three programmable phase lock loop clock signals: PLL1, PLL2, and PLL3 for the different modules in graphics/display controller 307. More particularly, while clock signal PLL1 is used for GE 406 and MIU 407, clock signals PLL2 and PLL3 are used for pixel processing logic 408. GE 406 processes graphics image data which is then stored in frame buffer 402 based on commands issued by the host CPU.

MIU 407 controls all read and write transactions from/to frame buffer 402. Such read and write requests may come from the host CPU via CIF 401, GE 406, pixel processing logic 408, FPI 409, etc. In addition, MIU 407 performs tasks associated with memory addressing, memory timing control, and others. Pixel processing logic 408 retrieves image data from frame buffer 402 via MIU 407, serializes the image data into pixels, and formats the pixels into predetermined formats before outputting them to FPI 209 or CRT DAC 210. Accordingly, pixel processing logic 408 generates the required horizontal and vertical display timing signals, memory addresses, read requests, and control signals to access image data stored in frame buffer 402. If the display device involved is a LCD, pixel data from pixel processing logic 408 is sent to FPI 409 before being passed on to the LCD. FPI 409 further processes the data by further adding different color hues or gray shades for display. Additionally, depending on whether a thin film transistor (TFT) LCD (a.k.a., active matrix LCD) or a super twisted nematic (STN) LCD (a.k.a., passive matrix LCD) is used, FPI 409 formats the data to suit the type of display. Furthermore, FPI 409 allows color data to be converted into monochrome data in the event a monochrome LCD is used. Conversely, if the display device is a cathode ray tube (CRT), pixel data is provided to CRT digital-to-analog converter (DAC) 410 prior to being sent to the CRT. CRT DAC 410 converts digital pixel data from pixel processing logic 408 to analog Red Green and Blue (RGB) signals to be displayed on the CRT monitor.

Figures 1, 5:
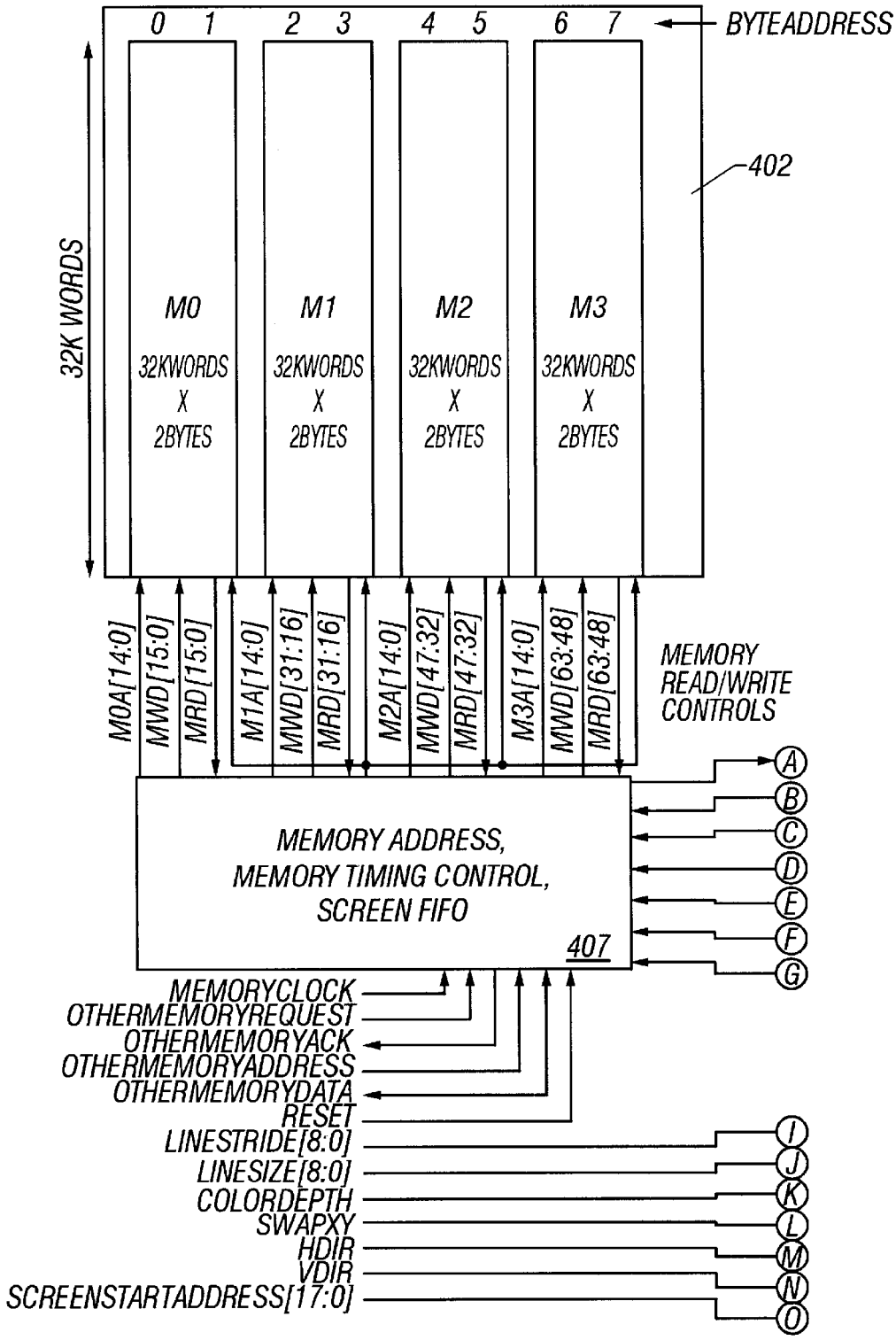
FIG. 5 illustrates in greater detail the most relevant components of graphics/display controller 307 and their interconnection that implement an embodiment of the present invention.
Figures 2, 5:
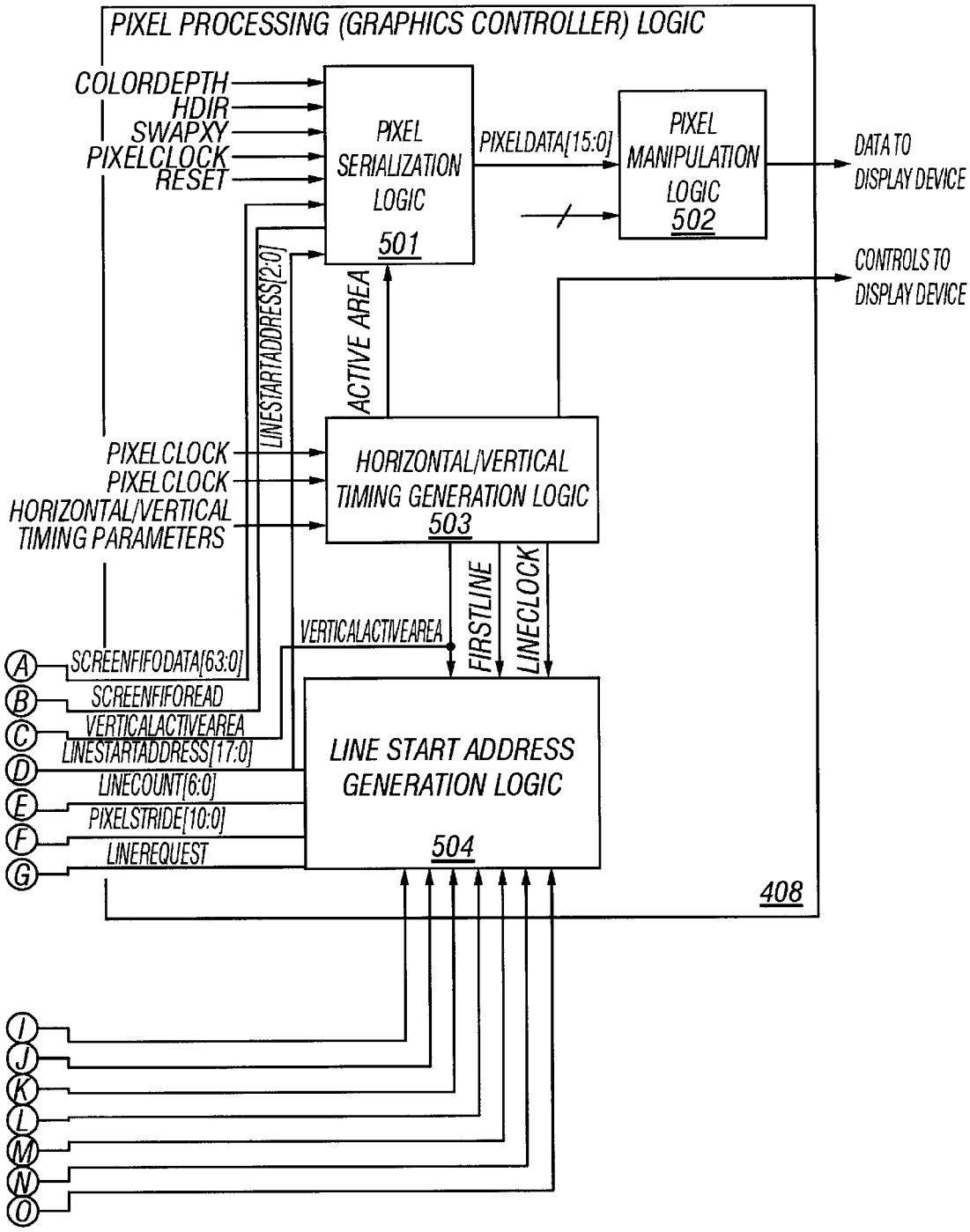

Reference is now made to FIG. 5 illustrating in greater detail the most relevant components of graphics/display controller 307 and their interconnection that implement an embodiment of the present invention. These components include frame buffer 402, MIU 407, and pixel processing logic 408. In the current embodiment, frame buffer 402 is made up of 4 memory modules M0–M3 each capable of storing 32K words where a word is 2 bytes. As such N is equal to 4 in the present embodiment. MIU 407 addresses memory modules M0–M4 individually via address buses M0A[14:0]–M3A[14:0], respectively. MIU 407 writes data into memory modules M0–M4 using Memory Write Data buses MWD[15:0], MWD[31:16], MWD[47:32], and MWD [63:48], respectively. MIU 407 reads data from memory modules M0–M3 using Memory Read Data buses MRD [15:0], MRD[31:16], MRD[47:32], and MRD[63:48], respectively. MIU 407 signals to memory modules M0–M3 whether a read or a write transaction is involved using Memory Read/Write Controls signals. In addition to pixel processing logic 408, such read and write requests may come from a number of other sources such as: the host CPU via CIF 401, GE 406, pixel processing logic 408, FPI 409, etc. Transaction request signals that MIU 407 may receive from the other sources include OtherMemoryRequest signal, OtherMemoryAddress signal. In response, MIU 407 generates OtherMemoryAck signal and OtherMemoryData signal. These transaction request signals from the other sources and the response signals are beyond the scope of this invention and are only provided here for completeness. MIU 407 also receives MemoryClock signal and Reset signal.

For image transformation, in the present embodiment, MIU 407 receives from pixel processing logic 408 ScreenFifoRead signal, VerticalActiveArea signal, LineStartAddress[17:0] signal, LineCount[6:0] signal, PixelStride[10:0] signal, and LineRequest signal. In response, MIU 407 outputs ScreenFifoData[63:0] signal to pixel processing logic 408. Pixel processing logic 408 generates the above signals based on inputs received from some programmable registers located in CIF 401 such as LineStride[8:0] signal, LineSize[8:0] signal, ColorDepth signal, SwapXY signal, Hdir signal, Vdir signal, ScreenStartAddress[17:0] signal, and Horizontal/Vertical Timing Parameters signals. Moreover, Pixel processing logic 408 receives PixelClock signal and Reset signal. The following are definitions for the aforementioned signals and others:

Reset signal is an active low asynchronous signal used in resetting a module.

Pixel Clock is the clock used by pixel processing logic 408 to output data pixel at a rate required by the display monitor.

LineStride[8:0] is a signal representing the linestride S which is the distance in pixels between any two vertically adjacent pixels in the stored display image (normal T0 transformation image).

LineSize[8:0] is a signal representing the number of pixels in a line in a relevant image transformation. LineSize is set to active display image area width W for T0–T3 transformations and to active display image area height H for T4–T7.

ColorDepth is a signal that indicates the color mode. When ColorDepth is 0, there are 8 bits used to represent each pixel. When ColorDepth is 1, there are 16 bits per pixel. This invention is applicable for other color depths also.

SwapXY is a signal indicating whether swapping of X and Y coordinates are enabled/disabled. If swapping of X and Y coordinates is disabled (SwapXY=0) the horizontal display axis is the x-axis of the stored image in frame buffer 402. If swapping of X and Y coordinates is enabled (SwapXY=1) the horizontal axis is the y-axis of the store image in frame buffer 402. Accordingly, a line can be either a row or a column of the stored image (normal T0 transformation image) in the frame buffer depending on the context.

Hdir is signal indicating whether the horizontal display scanning process involves incrementing (scanning in the +X direction if SwapXY=0 or scanning in +Y direction if SwapXY=1) or decrementing (scanning in the −X direction if SwapXY=0 or scanning in −Y direction if SwapXY=1).

Vdir is signal indicating whether the vertical display scanning process involves incrementing (scanning in the +Y direction if SwapXY=0 or scanning in +X direction if SwapXY=1) or decrementing (scanning in the −Y direction if SwapXY=0 or scanning in −X direction if SwapXY=1).

ScreenStartAddress[17:0] is a signal representing the address of one of four corner pixels of the active display image area depending on a specific transformation. For T0 and T4 transformation, the starting address is the top left pixel of the stored image (normal T0 transformation image). For T1 and T6 transformation, the starting address is the top right pixel of the stored image. For T2 and T5 transformation, the starting address is the bottom left pixel of the stored image. For T3 and T7, the starting address is the bottom right pixel of the stored image.

VerticalActiveArea is a signal that indicates it is time to process pixels because the pixels are within the active display rows. Similarly, HorizontalActiveArea is a signal that indicates it is time to process pixels because the pixels are within the active display columns. It follows then that ActiveArea signal is a signal that indicates it is time to process pixels because the pixels are within the active display image area (both active display columns and active display rows). The ActiveArea signal is generated by combining VerticalActiveArea signal and HorizontalActiveArea signal in an AND operation.

LineStartAddress[17:0] is a signal indicating the memory address of the first pixel to be serialized in each line.

LineStartAddress[17:0] needs to be updated at the beginning of each new line. LineStartAddress[2:0] represents the three least significant bits of the beginning address of each line. In other words, it is the address of the first pixel of the content of the 64-bit ScreenFifoData that is part of the beginning of the current line. Since the location of the first pixel in the first ScreenFifoData varies for each line of data, LineStartAddress[2:0] is used to locate this first pixel. For 8 bits per pixel color mode, all three bits of LineStartAddress are used to select the address of the first pixel out of eight possible locations. For 16 bits per pixel color mode, only two bits (LineStartAddress [2:1]) are used to select the address of the first pixel out of 4 possible locations.

ScreenFifoData[63:0] is a signal carrying 64 bits of image data from the frame buffer which has been copied into the screen FIFO inside MIU 407. The 64 bits of image data is part of the data associated with a line. The data associated with a line is copied and buffered in the screen FIFO until it is determined that the end of a line has been reached.

LineCount[6:0] is a signal indicating the number of memory read cycles required to fetch a line of data from the frame buffer.

PixelStride[8:0] is a signal indicating the distance between two adjacent pixels in two corresponding memories in a line.

Line Request is a signal indicating that the serialization of the previous line has been completed and a new line needs to be fetched from the frame buffer.

Depending on the desired image transformation, the CPU programs the SwapXY, Hdir, and Vdir registers with the appropriate values to indicate the sequencing direction (e.g., along a column or row, in the +X direction or −X direction, and in the +Y direction or −Y direction). The CPU further programs the ScreenStartAddress register with the appropriate starting address depending on the active display image area and the desired image transformation. The CPU programs the LineStride register with a line stride value that has been derived based, for example, on equation (1). Other relevant programmable registers include the LineSize and ColorDepth registers.

Figure 5A:
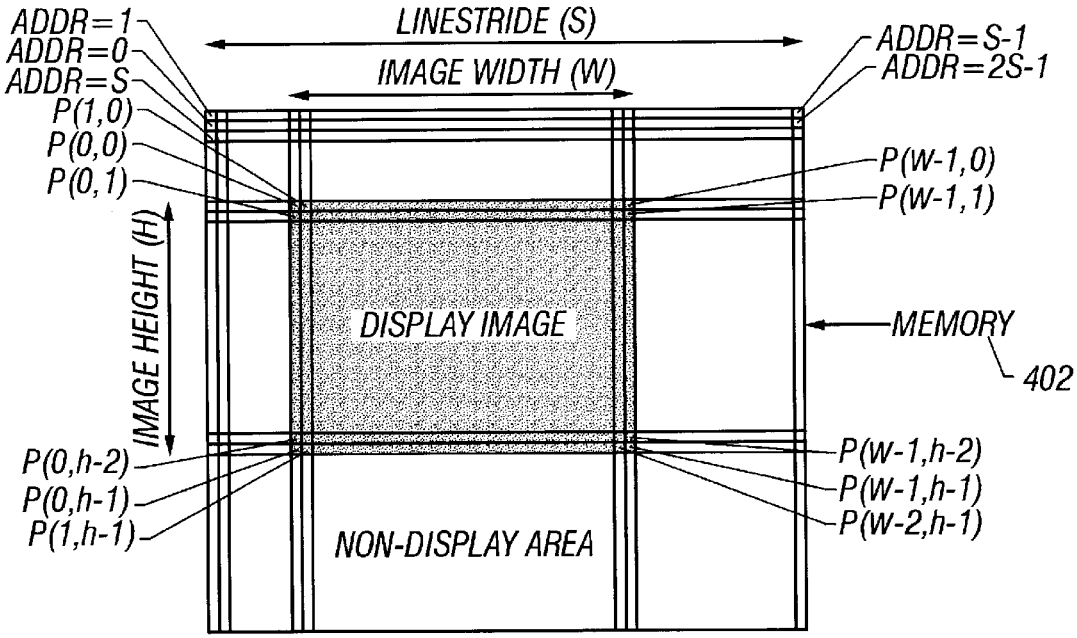
FIG. 5A illustrates, as an example, a logical representation of the display image relative to frame buffer 402.

FIG. 5A illustrates, as an example, a logical representation of the display image relative to frame buffer 402. As shown, the active display image at any one time is a subset of frame buffer 402 which is the larger block. The area outside of the active display image but inside frame buffer 402 is the non-active or non-display area. LineStride S is the width of frame buffer 402. A horizontal scan line is a line that is parallel to the LineStride S and is composed of a plurality of pixels each of which has a unique address. The display image width W is the width of the active display image and the image height H is the height of the active display image. The active display image can be anywhere in frame buffer 402. P(x,y) references the pixel at coordinate (x,y) of the display where x corresponds to the column position and y corresponds to the row position.

FIG. 5B illustrates, as an example, a physical representation of the display image relative to frame buffer 402 for 16 Bits-Per-Pixel (bpp) color mode. While a logical representation is provided strictly for ease of comprehension, a physical representation illustrates a more realistic frame buffer and how data is stored inside the frame buffer. In this embodiment, frame buffer 402 is made up of 4 memory modules M0–M3 wherein the length of each memory module can store 2 bytes (a word) of data. Since the ColorDepth is 16 bpp, each memory module's word accommodates only 1 pixel (Q=1) in this representation. On the other hand, if a 8 bpp color mode is involved, each memory module word can accommodate 2 pixels (Q=2). As shown, a row of display image data is stored sequentially from left to right with only the first four pixels and last four pixels in each row are shown for the sake of simplicity. The variable A indicates the memory address of the pixels. As shown, the addresses for horizontally adjacent pixels, which are located in different memory modules, are consecutive. In accordance with the present invention, the image data are stored serially with the image scan lines running the length of the frame buffer (i.e., linearly addressed within a line). As a result, FIG. 5B illustrates that any four consecutive horizontal adjacent pixels in a display image row are located in four (N×Q) different memory modules for 16 bpp color mode. For 8 bpp color mode, four horizontal adjacent pixel pairs (or eight (N×Q) consecutive horizontal adjacent pixels) are located in four different memory modules. It should be clear to a person of ordinary skill in the art that the same N×Q rule applies to other color modes. FIG. 5B further illustrates in accordance with the present invention that any four (i.e., N) consecutive vertically adjacent pixels in a display image column as logically illustrated in FIG. 5A (i.e., corresponding pixels in four adjacent rows) are also located in four different memory modules. This can be done by setting the LineStride S to an equation that has been derived to achieve the objective of having any four consecutive vertically adjacent pixels in a display image column locating in four different memory modules. In the present embodiment, LineStride (S)=N×I+P×Q (equation 1) where P is set to 1 in this embodiment. However, it should be clear to a person of ordinary skill in the art that other equations that meet the aforementioned objective are also within the scope of the present invention.

Referring now back to FIG. 5, pixel processing logic 408 comprises pixel serialization logic 501, pixel manipulation logic 502, horizontal/vertical timing generating logic 503, and line start address generation logic 504. In general, pixel processing logic 408 generates the timing and control signals to access data stored in frame buffer 402 in predetermined sequences to carry out the desired display image transformation. Additionally, pixel processing logic 408 serializes and formats the access image data prior to sending he display image data to the display devices. Pixel processing logic 408 also generates timing and control signals for the display devices. As shown in FIG. 5, pixel serialization logic 501 receives as inputs, ColorDepth signal, Hdir signal, SwapXY signal, PixelClock signal, Reset signal, ScreenFifoData[63:0] signal, LineStartAddress[2:0] signal, and Active Area signal. In response, pixel serialization logic 501 generates PixelData[15:0] signal and sends it to pixel manipulation logic 502 for formatting. Pixel serialization logic 501 also generates ScreenFifoRead signal for MIU 407. The formatted PixelData signal, which is output of the pixel manipulation logic 502, is then sent to the display device. The pixel manipulation logic 502 is beyond the scope of this invention. Horizontal/Vertical timing generation logic 503 receives as inputs PixelClock signal and Horizontal/Vertical timing parameters from programmable registers. In response, horizontal/vertical timing generation logic 503 generates timing signals including Active Area, VerticalActiveArea, FirstLine, and LineClock for pixel serialization logic 501, line start address generation logic 504, and MIU 407. Horizontal/vertical timing generation logic 503 may also generate the control signals for the display device which is beyond the scope of this invention. Line start address generation logic 504 receives as input VerticalActiveArea signal, FirstLine signal, and LineClock signal from horizontal/vertical timing generation logic. In addition, line start address generation logic 504 receives as inputs LineStride[8:0] signal, LineSize[8:0] signal, ColorDepth signal, SwapXY signal, Hdir signal, Vdir signal, and ScreenStartAddress[17:0] signal. In response, line start address generation logic 504 generates LineStartAddress [17:0] signal, LineCount[6:0], PixelStride[10:0] signal, and LineRequest signal to MIU 407. LineStartAddress[2:0] is also provided to pixel serialization logic 501.

Figure 6:
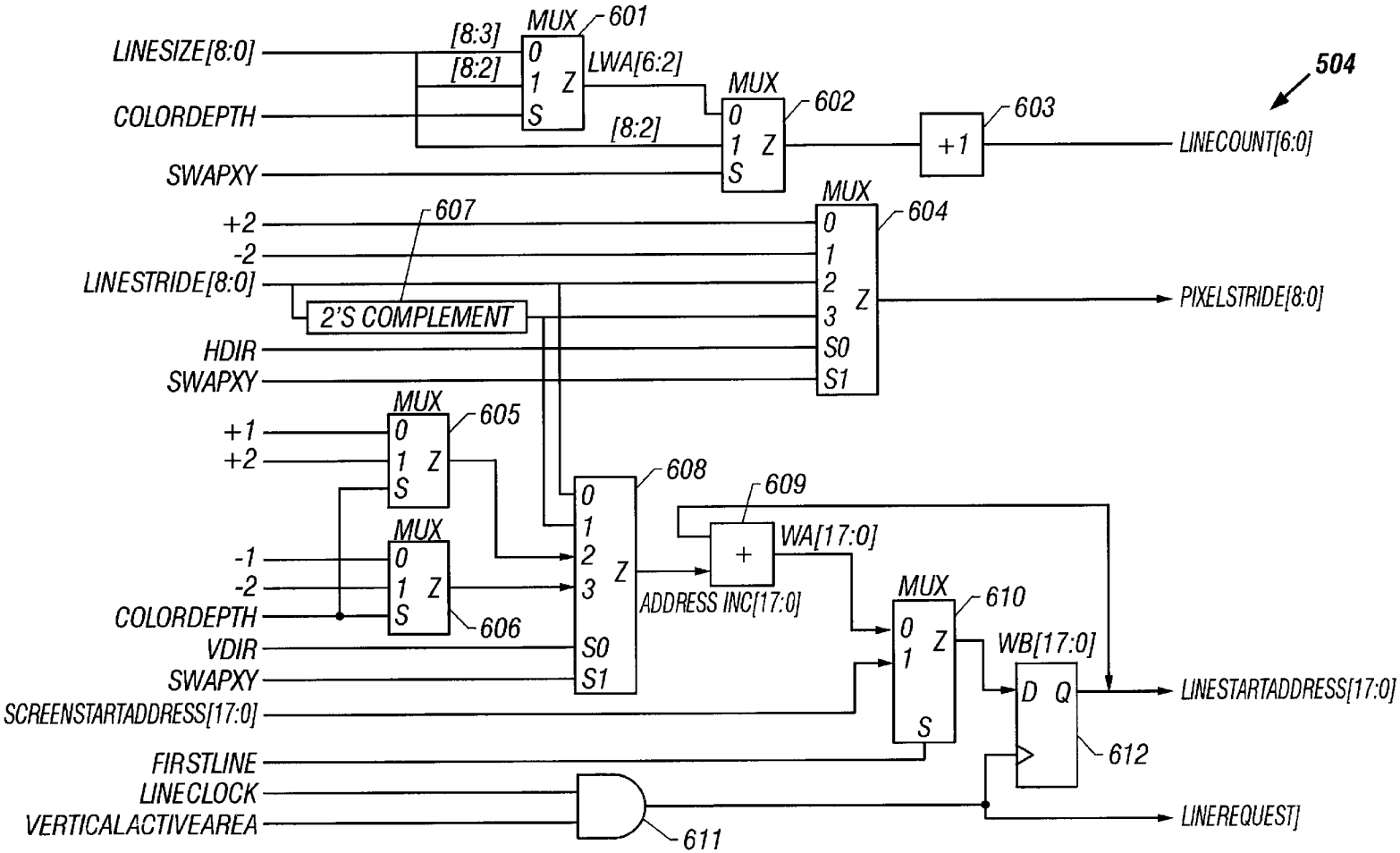
FIG. 6 illustrating in greater detail an embodiment of line start address generation logic 504.

Reference is now made to FIG. 6 illustrating in greater detail an embodiment of line start address generation logic 504. Generally, line start address generation logic 504 generates the address signals and control signals to be used by MIU 407 to access the image data stored in frame buffer 402 in a predetermined sequence to carry out a desired image transformation. ScreenStartAddress[17:0] signal is received from a programmable register and indicates the starting address of the active display image. The CPU from processing unit 305 sets the ScreenStartAddress[17:0] based on information on the desired display image transformation and the active display image area. ScreenStartAddress[17:0] signal is sent to multiplexer 610 at initialization when the multiplexer select signal, FirstLine, is 1. In other words, the initial value of LineStartAddress[17:0] is set to ScreenStartAddress[17:0]. The other input of multiplexer 610 is the output WA[17:0] of adder 609 which is used to compute an updated LineStartAddress by incrementing the current LinStartAddress by a predetermined count. Accordingly, adder 609 receives as inputs current LineStartAddress signal and AddressInc[17:0] signal. Multiplexers 605–606 and 608 are used to compute AddressInc[17:0] signal. Multiplexer 605 receives as inputs a +1 value and a +2 value which indicate the increment count in bytes to be added to the current LineStartAddress. The +1 value is used when ColorDepth signal indicates a 8 bpp color mode and a +2 value is used when ColorDepth signal indicates a 16 bpp color mode. Accordingly, multiplexer 605 receives as a select signal ColorDepth signal. Similarly, Multiplexer 606 receives as inputs a −1 value and a −2 value which indicate the decrement count in bytes to be subtracted from the current LineStartAddress. The −1 value is used when ColorDepth signal indicates a 8 bpp color mode and a −2 value is used when ColorDepth signal indicates a 16 bpp color mode. Accordingly, multiplexer 606 receives as a select signal ColorDepth signal. An increment value indicates that an image data row is scanned in the positive X direction (e.g., for T0 transformation) and a decrement value indicates that the image data row is scanned in the negative X direction (e.g., for T1 transformation). The outputs of multiplexers 605–606 are provided as inputs to multiplexer 608. In addition, multiplexer 608 receives as inputs LineStride S and its 2's complement (i.e., indicating—(LineStride S)). Multiplexer 608 receives as select signals Vdir signal, Hdir signal, and SwapXY signal. Multiplexer 608 passes LineStride S through as its output AddressInc[17:0] if SwapXY signal is 0 indicating XY swapping is disabled and Vdir is 0 indicating the vertical scanning direction is positive (incrementing Y direction). Multiplexer 608 passes through a negative (2's complement) LineStride S if SwapXY is 0 indicating XY swapping is disabled and Vdir is 1 indicating the vertical scanning direction is negative (decrementing Y direction). On the other hand, multiplexer 608 outputs as AddressInc[17:0] signal either a +1 or +2 if SwapXY is 1 indicating XY swapping is enabled and Vdir is 0 indicating the vertical scanning process is positive (incrementing X direction), or a −1 or −2 if SwapXY is 1 indicating XY swapping is enabled and Vdir is 1 indicating the vertical scanning process is negative (decrementing X direction).

FirstLine signal is provided to multiplexer 610 as a select signal. When FirstLine is 1 indicating that the first active line is being processed, multiplexer 610 outputs ScreenStartAddress[17:0] as the initial value. At other subsequent times (when FirstLine is 0), multiplexer 610 outputs WA[17:0] signal which is the updated LineStartAddress [17:0]. The output signal WB[17:0] of multiplexer 610 is provided as an input to latch 612 which also receives as a clock input LineRequest, the output of AND-gate 611. AND-gate 611 receives as inputs LineClock signal which indicates whether processing of the current line is complete and the next line needs to be processed and VerticalActiveArea signal which indicates whether the row being processed is within the vertical active area (i.e., is within the range of the active display image rows). Upon completing the process of a line, if the next line to be processed is within the range of the active display rows, AND-gate 611 asserts its output LineRequest signal to request for data related to the next line from MIU 402. Otherwise, AND-gate 611 deasserts LineRequest signal. LineRequest signal is used to trigger latch circuit 612 to latch in place its current output (when LineRequest signal is deasserted) or to replace its output with its current input (when LineRequest signal is asserted).

Similarly to multiplexer 608, multiplexer 604 is used to determine PixelStride[8:0] signal which represents the distance between a pixel in a memory word and the corresponding pixel in the next memory word. If no XY swapping is involved, the distance between two corresponding pixels in two adjacent memory words is two (2) bytes regardless of whether a 16 bpp color mode or 8 bpp color mode is involved. However, if XY swapping is involved, the distance between two corresponding pixels in two adjacent memory words is a LineStride S (distance between two pixels in a column). Accordingly, multiplexer 604 receives as input a +2 value, a −2 value, LineStride S, and negative LineStride S. Multiplexer 604 receives as select signals Hdir signal, and SwapXY signal. Multiplexer 604 passes LineStride S through as its output PixelStride[8:0] if SwapXY signal is 1 indicating XY swapping is enabled and Hdir is 0 indicating the horizontal scanning process is positive (incrementing Y direction). Multiplexer 604 passes through a negative LineStride S if SwapXY is 1 indicating XY swapping is enabled and Hdir is 1 indicating the vertical scanning process is negative (decrementing Y direction). On the other hand, multiplexer 604 outputs as PixelStride[8:0] signal a +2 if SwapXY is 0 indicating XY swapping is disabled (no swap) and Hdir is 0 indicating the horizontal scanning process is positive (incrementing X direction) or a −2 if SwapXY is 0 indicating XY swapping is disabled (no swap) and Hdir is 1 indicating the horizontal scanning process is negative (decrementing X direction).

Multiplexers 601–602 and adder 603 are used to generate LineCount[6:0] signal which is used to indicate the number of memory reads required to fetch a line of data in memory. The value of LineCount depends on the LineSize[8:0] parameters which are programmed in a programmable register and which indicate the number of pixels in a line. When SwapXY is disabled (0) indicating there is no XY swapping, LineCount[6:0] is equal to LineSize/8 if the ColorDepth value indicates that the color mode is 8 bpp and LineCount [6:0] is equal to LineSize/4 if the ColorDepth value indicates that the color mode is 16 bpp. When SwapXY is enabled (1), LineCount[6:0] is equal to LineSize/N where N is the number of memory modules in frame buffer 402 and in this embodiment N is 4. This is so because when swapping is enabled, the number of pixels per memory read access is limited to the number of memory modules to ensure that N vertically adjacent pixels are stored in N different memory modules. Accordingly, LineSize[8:0] signal is provided as inputs to multiplexer 601. More particularly, bits LineSize [8:3] are provided to one input and bits LineSize[8:2] are provided to a second input of multiplexer 601. ColorDepth signal is provided as a select signal to multiplexer 601 which outputs either LineSize[8:3] or LineSize[8:2] depending on the value of ColorDepth signal. In so doing, the LineSize value is effectively divided by eight and four depending on whether the ColorDepth is 8 bpp or 16 bpp, respectively. The output of multiplexer 601 is provided as an input to multiplexer 602 which receives as a second input bits LineSize [8:2]. SwapXY signal is provided as the select signal for multiplexer 602. Hence, multiplexer 602 outputs either LineSize[8:3] or LineSize[8:2] depending on the value of SwapXY signal. In so doing, multiplexer 602 effectively outputs a LineSize/(N=4) when SwapXY signal indicates that swapping is enabled and either LineSize/8 or LineSize/4 when SwapXY signal indicates that swapping is disabled. The output of multiplexer 602 is provided as an input to adder 603. Adder 603 adds one (1) to its input prior to outputting the sum as LineCount[6:0] signal. By adding one to value of LineCount, problems related to underfetching (i.e., the total number of pixels are not fetched per line due to various reasons such as LineCount not divisible by 4) is prevented. Adding one to value of LineCount may cause overfetching by 1 (there is one additional memory read per line) which in this embodiment does not cause functional problem. Methods to generate LineCount without causing overfetching are covered under this invention.

Figure 7:
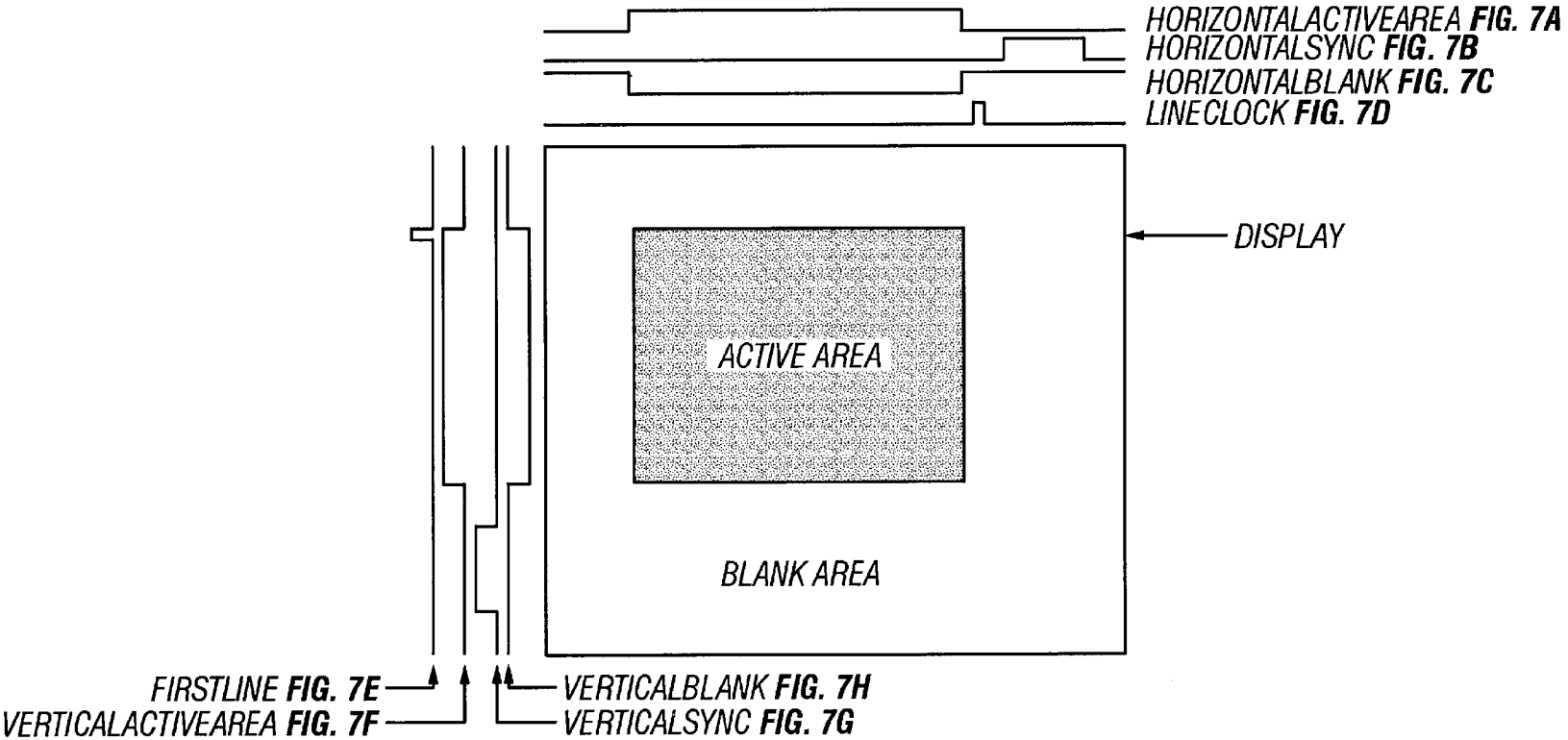
FIGS. 7A–7H illustrate, as examples, some of the timing signals generated by horizontal/vertical timing generation logic 503.

Horizontal/Vertical timing generation logic 503 is designed to generate horizontal and vertical timing signals that are used as control signals for pixel serialization logic 501, line start address generation logic 504, and the display device. The current embodiment supports standard display devices such as CRT monitors in which pixel data are sent serially from left to right and from top to bottom. It should be clear that other embodiments supporting other types of display devices are also within the scope of the present invention. Inputs to horizontal/vertical timing generation logic 503 are Reset signal, PixelClock signal, and various horizontal and vertical timing parameters that are programmed by the CPU in programmable registers. The horizontal and vertical timing parameters define the length of the horizontal active display image area, the length of the vertical active display image area, the length of the horizontal blank (non-active) area, the length of the vertical blank (non-active) area, the position of the horizontal sync, the position of the vertical sync, etc. For reference, the active and non-active image display areas related to the aforementioned timing signals are shown in FIG. 5A. FIGS. 7A–7H illustrate, as examples, some of the timing signals generated by horizontal/vertical timing generation logic 503. More particularly, FIG. 7A illustrates HorizontalActiveArea signal which has a pulse with a width that lasts for substantially the length of the horizontal active display image area to indicate the active horizontal area. FIG. 7B illustrates HorizontalSync signal which has a relatively short duration pulse that appears subsequent to the horizontal active display image area to indicate the end of the active horizontal area. FIG. 7C illustrates HorizontalBlank signal which is blanked only during the horizontal active display image area to indicate the non-active horizontal area. FIG. 7D illustrates LineClock signal which has a short pulse at the end of the horizontal active display image area to indicate the end of an active display image line. FIG. 7E illustrates Firstline signal having a short pulse just prior to occurrence of the first line in vertical active display image area to indicate the occurrence of this first line. FIG. 7F illustrates VerticalActiveArea signal which has a pulse with a width that lasts for substantially the length of the vertical active display image area to indicate the active vertical area. FIG. 7G illustrates VerticalSync signal which has a relatively short pulse that appears subsequent to the vertical active display image area to indicate the end of the active vertical area. Finally, FIG. 7H illustrates VerticalBlank signal which is blanked only during the vertical active display image area to indicate the non-active horizontal area. The implementation details of horizontal/vertical timing generation logic 503 should be obvious to anyone of ordinary skill in the art and is therefore not described any further for brevity and simplicity sake.

Figure 8:
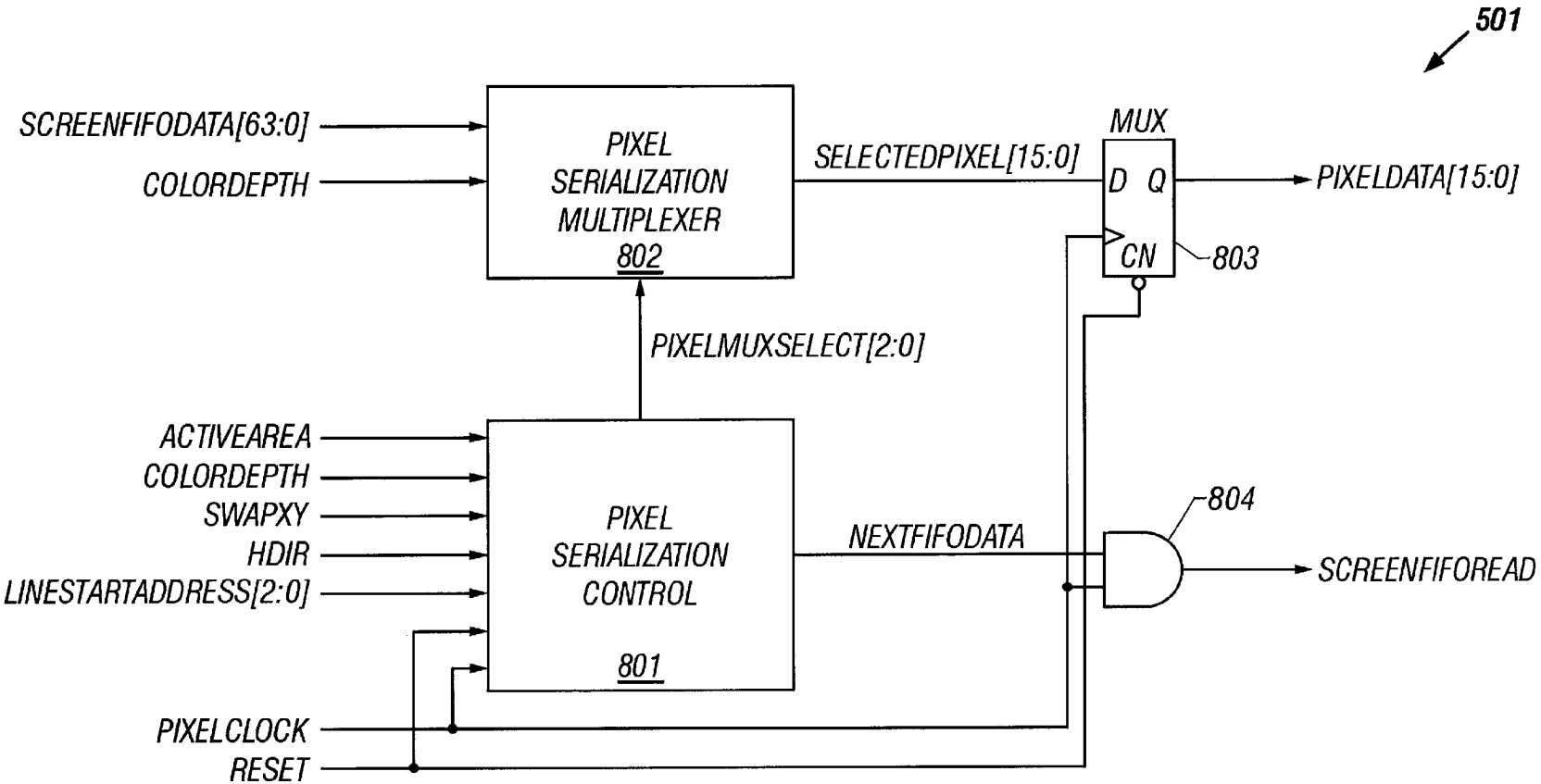
FIG. 8 illustrates in greater detail an embodiment of pixel serialization logic 501.

Reference is now made to FIG. 8 illustrating in greater detail an embodiment of pixel serialization logic 501. In general, pixel serialization logic 501 is designed to serialize data from ScreenFifoData signal which consists of multiple parallel pixels read from frame buffer memory 402 into a data stream of one pixel per clock. As shown in FIG. 8, pixel serialization logic 501 comprises of pixel serialization control logic 801, pixel serialization multiplexer 802, latch circuit 803, and AND-gate 804. Pixel serialization control logic 801 receives as inputs ActiveArea signal, ColorDepth signal, SwapXY signal, Hdir signal, LineStartAddress[2:0] signal, PixelClock signal, and Reset signal. In response, pixel serialization control logic 801 outputs PixelMuxSelect [2:0] signal to pixel serialization multiplexer 802 for use as select signal and NextFifoData signal. To generate PixelMuxSelect[2:0] signal, pixel serialization control logic 801 uses information provided by SwapXY signal and Hdir signal to determine whether a swap is involved as well as the scanning direction. Using the derived information in combination with LineStartAddress[2:0] signal of a line which is within the active display image area (e.g., as indicated by the rising edge of ActiveArea signal), PixelMuxSelect[2:0] signal determines the appropriate line start address. Pixel serialization control logic then resets and initializes PixelMuxSelect[2:0] signal to the appropriate line start address at the beginning of each such line. PixelMuxselect [2:0] is synchronized with PixelClock signal to ensure that only one pixel is allowed through by pixel serialization multiplexer 802 for every pixel clock cycle. Using information derived from ColorDepth signal, pixel serialization control logic 801 determines when a new word (e.g., 64 bits) of data that is still within the active display image area is required by pixel serialization multiplexer 802 so that PixelMuxSelect[2:0] signal can be updated and NextFifoData signal can be set to one (1). Accordingly, pixel serialization multiplexer 802 receives as input ScreenFifoData [63:0] signal and selectively outputs, based on PixelMuxSelect[2:0] signal, SelectedPixel[15:0] signal to latch circuit 803. Latch circuit 803 also receives PixelClock signal for clocking and reset signal for resetting. Latch circuit 803 outputs PixelData[15:0] signal to pixel manipulation logic 502 for formatting.

NextFifoData signal is combined with PixelClock signal by AND-gate 804 to generate ScreenFifoRead signal which is sent to MIU 407 (more specifically to the Screen FIFO inside MIU 407) to read the next word. The implementation details of pixel serialization control logic 801 should be obvious to anyone of ordinary skill in the art and is therefore not described any further for brevity and simplicity sake.

Figures 1, 9:
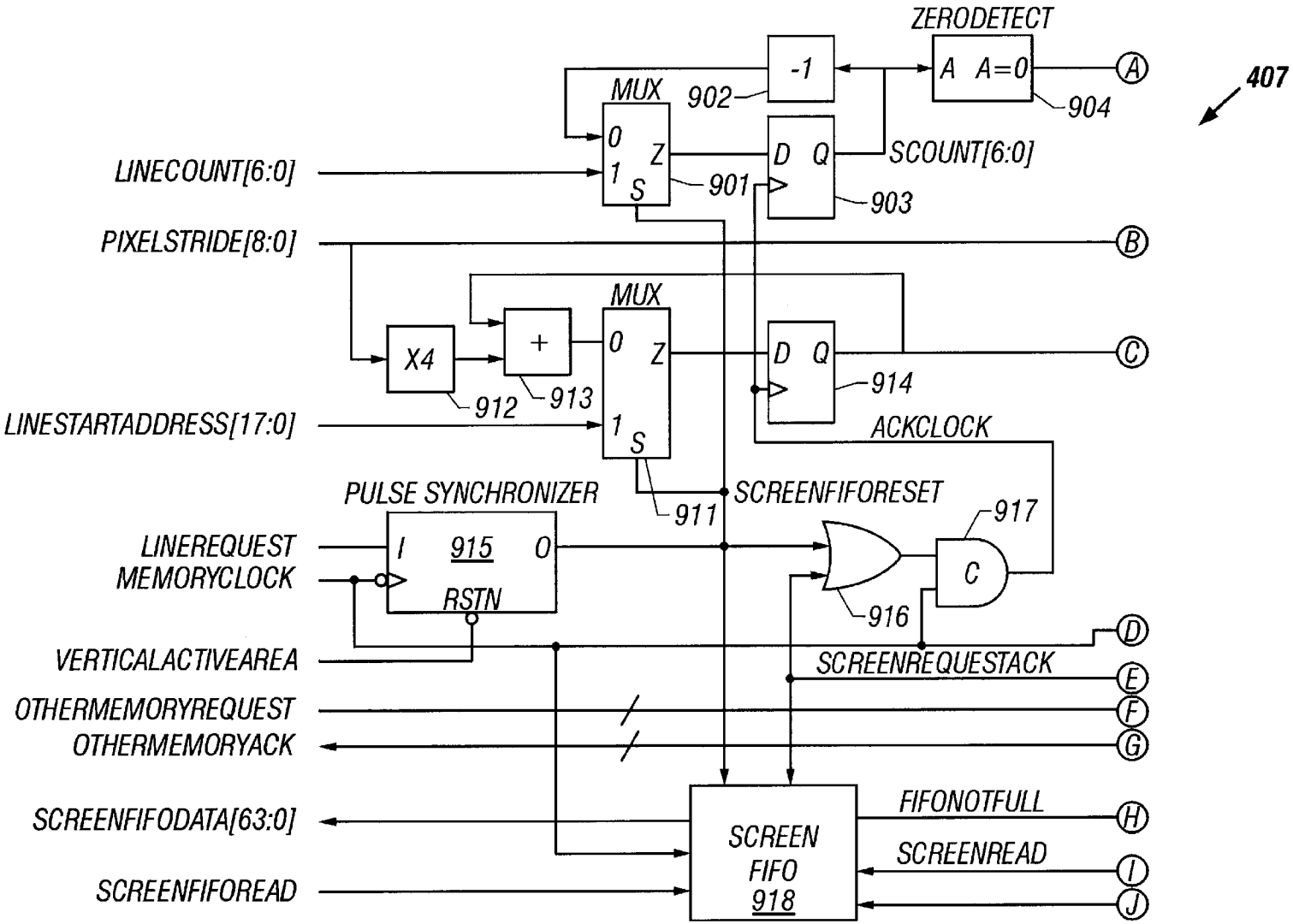
FIG. 9 illustrates in greater detail exemplary components of MIU 407 that are relevant to the present invention.
Figures 2, 9:
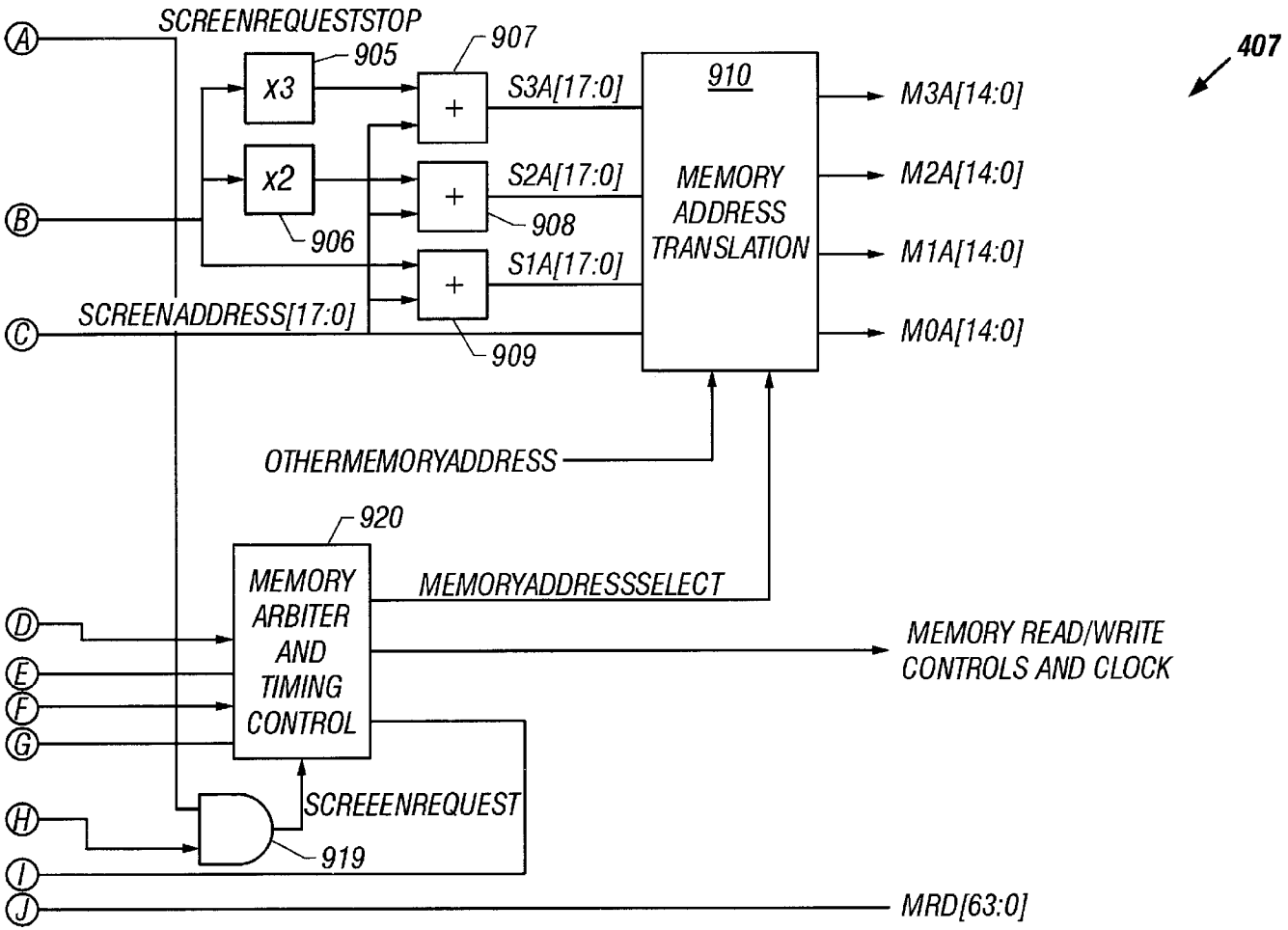

Referring now to FIG. 9 illustrating in greater detail exemplary components of MIU 407 that are relevant to the present invention. In general, these relevant components of MIU 407 are designed to take the signals generated by pixel processing logic 408 such as ScreenFifoRead signal, VerticalActiveArea signal, LineStartAddress signal, LineCount signal, PixelStride signal, and LineRequest signal and translate them into memory control signals to access frame buffer 402. The components of MIU 407 that are relevant to the present invention comprises: multiplexer 901, adder 902, latch circuit 903, zero detector 904, multipliers 905–506, adders 907–909, memory address translation 910, multiplexer 911, multiplier 912, adder 913, latch circuit 914, pulse synchronizer 915, OR-gate 916, AND-gate 917, Screen FIFO 918, AND-gate 919, and memory arbiter & timing control 920. To simplify the hardware required, all the multipliers in MIU 407 may be implemented as shifters and in some cases adders.

Multiplexer 911, multiplier 912, adder 913, and latch circuit 914 combine to determine ScreenAddress[17:0] signal used in accessing memory modules M0–M3 of frame buffer 402. LineStartAddress[17:0] signal is provided as one input to multiplexer 911 which receives a second input from the output of adder 913. Adder 913 receives as one input the present ScreenAddress[17:0] signal and the output of multiplier 912 as a second input. Multiplier 912 receives as input PixelStride[8:0] signal and proceeds to multiply the value of this signal by N (×N), in the present embodiment, N is equal to four (4) so multiplier 912 carries out a (×4) multiplication. Multiplier 912 outputs the result to adder 913 which adds the value 4×PixelStride to the current ScreenAddress value to generate an updated ScreenAddress value. The ScreenAddress value is updated by adding the value 4×PixelStride to the current ScreenAddress value because each screen data memory read cycle can access consecutive memory locations spanning 4 memory modules M0–M3. Multiplexer 911 receives as a select signal ScreenFifoReset signal which is a pulse (one MemoryClock wide) generated by synchronizing LineRequest signal when it is going active with MemoryClock signal which in the current embodiment is asynchronous with PixelClock signal. Latch circuit 914 latches ScreenAddress[17:0] signal and provided the latched signal to adders 907–909 and memory address translation logic 910. Latch circuit 914 is clocked by AckClock signal which is a gated clock signal generated by combining ScreenFifoReset signal with ScreenRequestAck signal, which indicates that a ScreenRequest signal has been received, using OR-gate 916 and then combining the output of OR-gate 916 with MemoryClock signal. In so doing, latch circuit 914 latches in place its output when LineRequest signal is going from inactive (0) to active (1) or when ScreenRequestAck signal is active. Both ScreenFifoReset and ScreenRequest Ack are rising and falling when MemoryClock is low so that AckClock is glitch free.

Memory address translation logic 910 examines bits 1 and 2 of ScreenAddress[17:0] signal to determine whether the corresponding pixel is in memory module M0, M1, M2, or M3 and generates the address for accessing the appropriate memory module accordingly. Adders 907–909 and multipliers 905–906 are used to generate addresses to access all N memory modules based on ScreenAddress[17:0] signal and PixelStride[8:0] signal. To do so, adder 909 adds the value PixelStride to the updated ScreenAddress[17:0] signal to address the immediately subsequent memory module, adder 908 adds two times (2×) the value PixelStride to the updated ScreenAddress[17:0] signal to address the next subsequent memory module, and adder 907 adds three times (3×) the value PixelStride to the updated ScreenAddress[17:0] to address the next to next subsequent memory module. Accordingly, multiplier 905 carries out a times three (×3) multiplication of the PixelStride and multiplier 906 carries out a times two (×2) multiplication of the PixelStride. Memory address translation logic 910 examines bits 1 and 2 of output of adders 907–909 to determine whether output of these adders correspond to memory module M0, M1, M2, or M3 and apply the output of these adders as addresses to the corresponding memory modules.

Multiplexer 901, adder 902, latch circuit 903, and zero detector 904 combine to monitor the remaining number of memory reads required to access a line of image data. LineCount[6:0] signal is provided as an input to multiplexer 901 which receives as a second input the output of adder 902. Multiplexer 901 receives as a select signal ScreenFifoReset signal whose generation has been discussed above. The output of multiplexer 901 is provided as an input to latch circuit 903 which is clocked by AckClock signal whose generation has also been discussed above. Adder 902 receives as input Scount[6:0] which is the latched LineCount [6:0] signal and subtracts the value one (1) from its input to account for each memory read. Zero detector 904 also receives as input Scount[6:0] signal. Zero detector 904 monitors the value of SCount[6:0] signal to determine if it has reached zero (0). If Scount[6:0] signal is zero indicating that the line of image data has been completely accessed, zero detector 904 asserts its output ScreenRequestStop signal to so indicate. If not, zero detector 904 deasserts ScreenRequestStop signal.

In addition to memory access requests generated by pixel processing logic 501, frame buffer 402 also gets memory access requests from external sources. For this reason, memory arbiter & timing control logic 920 is used to determine the priority of concurrent memory access requests that may occur and generate the required memory control signals. Memory arbiter & timing control logic 920 receives as inputs MemoryClock signal for clocking, OtherMemoryRequest signal, and ScreenRequest signal. ScreenRequest signal is the output of AND-gate 919 which receives as inputs ScreenRequestStop signal and FifoNotFull signal from Screen FIFO 918. Screen FIFO 918 provides a buffer for a plurality of data words received from frame buffer 402 before outputting it on ScreenFifoData[63:0] signal to pixel processing logic 408. Hence, Screen FIFO 918 asserts a FifoNotFull signal when it has one or more empty locations to ask memory arbiter & timing control for the next 64-bits data word in the line. FifoNotFull signal and ScreenRequestStop signal are both provided as inputs to AND-gate 919 which asserts ScreenRequest signal only if Screen FIFO 918 is empty and there is more data in the line to access. Otherwise, AND-gate 919 deasserts ScreenRequest signal. Memory arbiter & timing control 920 generates a ScreenRequestAck signal which is provided to Screen FIFO 918 in response to a ScreenRequest signal and an OtherMemoryAck signal in response to an OtherMemoryRequest signal. Memory arbiter & timing control circuit 920 then generates MemoryAddressSelect signal to select the proper memory address to access frame buffer 402. If memory arbiter & timing control 920 decides that the memory access is on behalf of Screen FIFO 918 (ScreenRequest) then the MemoryAddressSelect signal will indicate to MemoryAddressTranslation 910 to select ScreenAddress[17:0] and output of adders 907–909 as addresses for memory modules M0–M3 of frame buffer 402. If memory arbiter & timing control 920 decides that the memory access is on behalf of OtherMemoryRequest then the MemoryAddressSelect signal will indicate to MemoryAddressTranslation 910 to select OtherMemoryAddress as addresses for frame buffer 402. Memory arbiter & timing control 920 also generates memory read/write controls and clock signals to perform the actual read or write access to the frame buffer memory 402. In response to frame buffer 402 read access due to ScreenRequest, frame buffer 402 provides 64-bits of image data related to each accessed memory read on memory read data bus MRD[63:0] to Screen FIFO 918. Concurrently, memory arbiter & timing control 920 asserts ScreenRead signal to latch the 64-bits data provided by MRD[63:0] into Screen FIFO 918. When Screen FIFO 918 receives an asserted ScreenFifoRead signal from pixel serialization logic 501, screen FIFO 918 reads from the next FIFO location and outputs the content on ScreenFifoData[63:0] signal. Screen FIFO 918 also synchronizes the reception of both ScreenRead signal and ScreenFifoRead signal with MemoryClock signal to update FifoNotFull signal.

An embodiment of the present invention, a system, apparatus, and method to transform a display image that are conducive to miniaturization and inexpensive to implement, is presented. While the present invention has been described in particular embodiments, the present invention should not be construed as limited by such embodiments, but rather construed according to the below claims.

What is claimed is:

1. A graphics controller coupled to system memory comprises:

a frame buffer including N memory modules for storing image data copied from the system memory, wherein each memory module is individually accessible and each word in each memory module consisted of Q number of pixels, the image data stored in the frame buffer is arranged serially based on a line stride value such that N×Q horizontally adjacent pixels are located in N different memory modules and corresponding pixels of N adjacent rows of the stored image data are located in N different memory modules; and a combinational logic coupled to the frame buffer, the combinational logic generating a starting address signal and control signals used in selectively accessing the stored imaged data in the frame buffer for output such that the output image data is transformed.

2. The graphics controller of claim 1, wherein the combinational logic receiving as inputs a line stride signal carrying the line stride value, a line size signal, sequencing direction signals based on a desired transformation, and an active display image area starting address signal.

3. The graphics controller of claim 2, wherein the sequencing direction signals include an SwapXY signal, a Hdir signal, and a Vdir signal.

4. The graphics controller of claim 3, wherein the starting address signal is a line start address signal and the control signals include a line request signal, a line count signal, a pixel stride signal, and a vertical active area signal.

5. The graphics controller of claim 4 further comprising a Memory Interface Unit (MIU) coupled to the frame buffer and the combinational logic, the MIU selectively accessing the stored image data in the frame buffer for output by individually accessing each memory module using the line start address signal, the line request signal, the line count signal, the pixel stride signal, and the vertical active area signal generated by the combinational logic.

6. The graphics controller of claim 5, wherein the combinational logic comprising:

a horizontal/vertical timing generation logic receiving as inputs horizontal and vertical timing parameters and a pixel clock signal, the horizontal/vertical timing generation logic generating an active area signal, the vertical active area signal, a first line signal, a line clock signal, and a plurality of control signals to a display device; and a line start address generation logic receiving as inputs a line stride signal, the line size signal, the SwapXY signal, the Hdir signal, the Vdir signal, the active display image area starting address signal, the first line signal, the line clock signal, and the vertical active area signal, the line start address generation logic generating the line start address signal, the line request signal, the line count signal, and the pixel stride signal.

7. The graphics controller of claim 6, wherein the combinational logic further comprising:

a pixel serialization logic coupled to the MIU for serializing the accessed image data into a stream of pixels in response to inputs received including the color depth signal, the Hdir signal, the SwapXY signal, the pixel clock signal, and the active area signal; and a pixel manipulation logic coupled to the pixel serialization logic for formatting the stream of pixels for output in a display device.

8. A computer system comprising:

a central processing unit (CPU);

system memory coupled to the CPU;

a graphics/display controller coupled to the CPU and the system memory, the graphics controller comprising:

a frame buffer including N memory modules for storing image data copied from the system memory, wherein each memory module is individually accessible and each word in each memory module consisted of Q number of pixels, the image data stored in the frame buffer is arranged serially based on a line stride value such that N×Q horizontally adjacent pixels are located in N different memory modules and corresponding pixels of N adjacent rows of the stored image data are located in N different memory modules; and a combinational logic coupled to the frame buffer, the combinational logic generating a starting address signal and control signals used in selectively accessing the stored imaged data in the frame buffer for output such that the output image data is transformed.

9. The computer system of claim 8, wherein the combinational logic receiving as inputs a line stride signal carrying the line stride value, a line size signal, sequencing direction signals based on a desired transformation, and an active display image area starting address signal.

10. The computer system of claim 9, wherein the sequencing direction signals include an SwapXY signal, a Hdir signal, and a Vdir signal.

11. The computer system of claim 10, wherein the starting address signal is a line start address signal and the control signals include a line request signal, a line count signal, a pixel stride signal, and a vertical active area signal.

12. The computer system of claim 11, wherein the graphics controller further comprising a Memory Interface Unit (MIU) coupled to the frame buffer and the combinational logic, the MIU selectively accessing the stored image data in the frame buffer for output by individually accessing each memory module using the line start address signal, the line request signal, the line count signal, the pixel stride signal, and the vertical active area signal generated by the combinational logic.

13. The computer system of claim 12, wherein the combinational logic comprising:

a horizontal/vertical timing generation logic receiving as inputs horizontal and vertical timing parameters and a pixel clock signal, the horizontal/vertical timing generation logic generating an active area signal, the vertical active area signal, a first line signal, a line clock signal, and a plurality of control signals to a display device; and a line start address generation logic receiving as inputs a line stride signal, the line size signal, the SwapXY signal, the Hdir signal, the Vdir signal, the active display image area starting address signal, the first line signal, the line clock signal, and the vertical active area signal, the line start address generation logic generating the line start address signal, the line request signal, the line count signal, and the pixel stride signal.

14. The computer system of claim 13, wherein the combinational logic further comprising:

a pixel serialization logic coupled to the MIU for serializing the accessed image data into a stream of pixels in response to inputs received including the color depth signal, the Hdir signal, the SwapXY signal, the pixel clock signal, and the active area signal; and a pixel manipulation logic coupled to the pixel serialization logic for formatting the stream of pixels for output in a display device.

15. A method to transform digital image data stored in memory, the method comprising:

copying the digital image data from memory to a frame buffer including N memory modules, wherein each memory module is individually accessible;

serially arranging the image data stored in the frame buffer based on a line stride value such that N×Q horizontally adjacent pixels are located in N different memory modules and corresponding pixels of N adjacent rows of the stored image data are located in N different memory modules; and selectively accessing the stored imaged data in the frame buffer for output in a sequence such that the output image data is transformed.

16. The method of claim 15, wherein the accessing step is controlled by a starting address signal and control signals generated in response to input signals including: a line stride signal carrying the line stride value, a line size signal, sequencing direction signals based on a desired transformation, and an active display image area starting address signal.

17. The method of claim 16, wherein the sequencing direction signals include an SwapXY signal, a Hdir signal, and a Vdir signal.

18. The method of claim 17, wherein the starting address signal is a line start address signal and the control signals include a line request signal, a line count signal, a pixel stride signal, and a vertical active area signal.

19. The method of claim 18, wherein the step of accessing involves individually accessing each memory module using the line start address signal, the line request signal, the line count signal, the pixel stride signal, and the vertical active area signal generated by the combinational logic.

20. The method of claim 19 further comprising the steps of:

serializing the accessed image data into a stream of pixels in response to inputs received including the color depth signal, the Hdir signal, the SwapXY signal, the pixel clock signal, and the active area signal; and formatting the stream of pixels for output in a display device.

* * * * *